US005501235A

United States Patent [19]

Watanabe

[11] Patent Number: 5,501,235

[45] Date of Patent: Mar. 26, 1996

[54] TOBACCO BAND APPARATUS FOR A CIGARETTE MANUFACTURING MACHINE

[75] Inventor: Tomoichi Watanabe, Tokyo, Japan

[73] Assignee: Japan Tobacco Inc., Tokyo, Japan

[21] Appl. No.: 408,864

[22] Filed: Mar. 23, 1995

[30] Foreign Application Priority Data

Mar. 28, 1994 [JP] Japan ..... 6-057709

[51] Int. Cl.[6] ..... A24C 5/18

[52] U.S. Cl. ..... 131/84.1; 198/835

[58] Field of Search ..... 131/84.1–84.3, 131/108; 198/842, 835

[56] References Cited

U.S. PATENT DOCUMENTS 4,118,179 10/1978 Ballinger ..... 198/835 X
4,729,386 3/1988 Heitmann ..... 131/84.1
5,337,761 8/1994 Okumoto .

FOREIGN PATENT DOCUMENTS 4215059 11/1993 Germany .
1042505 9/1966 United Kingdom .

*Primary Examiner*—Jennifer Bahr
*Attorney, Agent, or Firm*—Birch, Stewart, Kolasch & Birch

[57] ABSTRACT

A tobacco band apparatus for a cigarette manufacturing machine includes a tobacco band passed around a head pulley and a tail pulley, a plurality of guide rollers arranged between the head pulley and the tail pulley for guiding the tobacco band, a tension pulley for applying a predetermined tensile force to the tobacco band, a change-direction pulley for increasing the angle by which the tobacco band is wound around the head pulley, and a power transmission path for transmitting a driving force input to the head pulley to the tail pulley, the guide rollers, the tension pulley and the change-direction pulley to rotate these pulleys and rollers synchronously with each other at an identical peripheral speed.

8 Claims, 5 Drawing Sheets

TOBACCO BAND APPARATUS FOR A CIGARETTE MANUFACTURING MACHINE

BACKGROUND OF THE INVENTION

1. Field of the Invention

This invention relates to a tobacco band apparatus incorporated in a cigarette manufacturing machine, and more particularly, to a tobacco band apparatus having a tobacco band capable of high-speed travel.

2. Description of the Related Art

A cigarette manufacturing machine generally comprises a tobacco band apparatus, a wrapping section, and a cutting section. The tobacco band apparatus has an endless tobacco band to which shredded tobacco is attracted by suction in the form of a layer. More specifically, the tobacco band is passed round a head pulley located close to the wrapping section and a tail pulley located close to a chimney for feeding shredded tobacco toward the tobacco band. The tobacco band travels in one direction as the head pulley rotates.

As the tobacco band travels, the shredded tobacco layer formed on the tobacco band is transported toward the wrapping section where the shredded tobacco is fed onto paper from a paper web. The paper from the web is caused to travel at a fixed speed in the wrapping section, and in this process of travel, the shredded tobacco is wrapped in the paper to thereby continuously form a cigarette rod. The cigarette rod thus formed is supplied from the wrapping section to the cutting section, and is cut into cigarettes with a predetermined length in the cutting section.

In order to improve the productivity of cigarettes, first of all, the speed of feeding shredded tobacco onto the paper, that is, the traveling speed of the tobacco band, need be increased. Since, however, the tobacco band is driven by rotation of the head pulley alone, as mentioned above, there occurs a large difference between the tensile force acting on a portion of the tobacco band passing around the head pulley and the tensile force acting on the other portion of the tobacco band. The difference of tension increases with the traveling speed of the tobacco band, that is, with the peripheral speed of the head pulley.

If the tension of the tobacco band is not uniform along the longitudinal direction thereof, the tobacco band is liable to slacken. Slackening of the tobacco band leads to a shorter service life and unstable attraction of the shredded tobacco to the tobacco band. As a result, the amount of shredded tobacco fed from the tobacco band onto the paper cannot be controlled uniformly.

SUMMARY OF THE INVENTION

It is an object of this invention to provide a tobacco band apparatus for a cigarette manufacturing machine which permits both high-speed travel and long service life of a tobacco band.

The above object is achieved by a tobacco band apparatus according to this invention, which comprises a plurality of guide rollers rotatably arranged between a head pulley and a tail pulley for guiding a straight portion of a traveling tobacco band used for attracting shredded tobacco thereto, tension means for applying a predetermined tensile force to the tobacco band, and drive means for rotating the head pulley, the tail pulley and the guide rollers synchronously with each other in an identical direction at an identical peripheral speed.

In the tobacco band apparatus of this invention, the head pulley, the tail pulley and the guide rollers are rotated synchronously with each other at an identical peripheral speed, whereby the tobacco band travels in one direction. Specifically, the tobacco band is caused to travel by driving force exerted not only by the head pulley but also by the guide rollers and the tail pulley, and thus the tension necessary to drive the tobacco band can be reduced. Accordingly, the traveling speed of the tobacco band can be increased without increasing the tensile force applied to the tobacco band.

Since the straight portion of the tobacco band is guided by a plurality of guide rollers, it is never locally slackened. Accordingly, even when the traveling speed of the tobacco band is increased, shredded tobacco is reliably attracted to the straight portion of the band in the form of a layer and the supply of shredded tobacco from the tobacco band to a wrapping section is stabilized.

Besides the tail pulley, the guide rollers are also rotated; therefore, the tobacco band does not slip on the tail pulley or the guide rollers, whereby wear of the tobacco band is greatly reduced, enhancing durability of the tobacco band.

The aforementioned drive means includes a power transmission path for transmitting a driving force input to the head pulley to the tail pulley through the guide rollers, and this power transmission path includes a toothed pulley arranged coaxially with each of the head pulley, the tail pulley and the guide rollers, and an endless toothed belt passed round each pair of adjacent ones of the toothed pulleys. When driving force is input to the head pulley, it is transmitted from the head pulley successively through the guide rollers to the tail pulley, whereby the guide rollers and the tail pulley are rotated, together with the head pulley, synchronously with each other.

Preferably, the tension means includes a tension lever rotatably disposed, a tension pulley rotatably mounted on the tension lever and guiding the tobacco band, urging means for pressing the tension pulley against the tobacco band, and second drive means for rotating the tension pulley and the head pulley synchronously with each other at an identical peripheral speed.

In this case, the tension pulley also is rotated to drive the tobacco band; therefore, it does not increase the tension of the tobacco band locally. Further, since the tobacco band does not slip on the tension pulley, wear of the tobacco band can be reduced. Like the first drive means, the second drive means can be easily implemented by using a toothed pulley arranged coaxially with each of the head pulley and the tension pulley, and an endless toothed belt passed round the toothed pulleys.

The tobacco band apparatus may further include increasing means for increasing the contact angle by which the tobacco band is wound around the head pulley. The increasing means includes a change-direction pulley associated with the tobacco band, which is rotatably arranged between the head pulley and the tension pulley with respect to the traveling direction of the tobacco band. Thus, after passing the head pulley, the tobacco band is once directed toward the tail pulley, and then is turned back toward the tension pulley by the change-direction pulley. Accordingly, the area of contact between the tobacco band and the outer peripheral surface of the head pulley is sufficiently large, whereby rotation of the head pulley permits stable travel of the tobacco band.

The change-direction pulley may also be rotated at a peripheral speed equal to that of the head pulley, in order to drive the tobacco band. In this case, the change-direction pulley neither increases the tension of the tobacco band locally nor expedites wear of the tobacco band.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
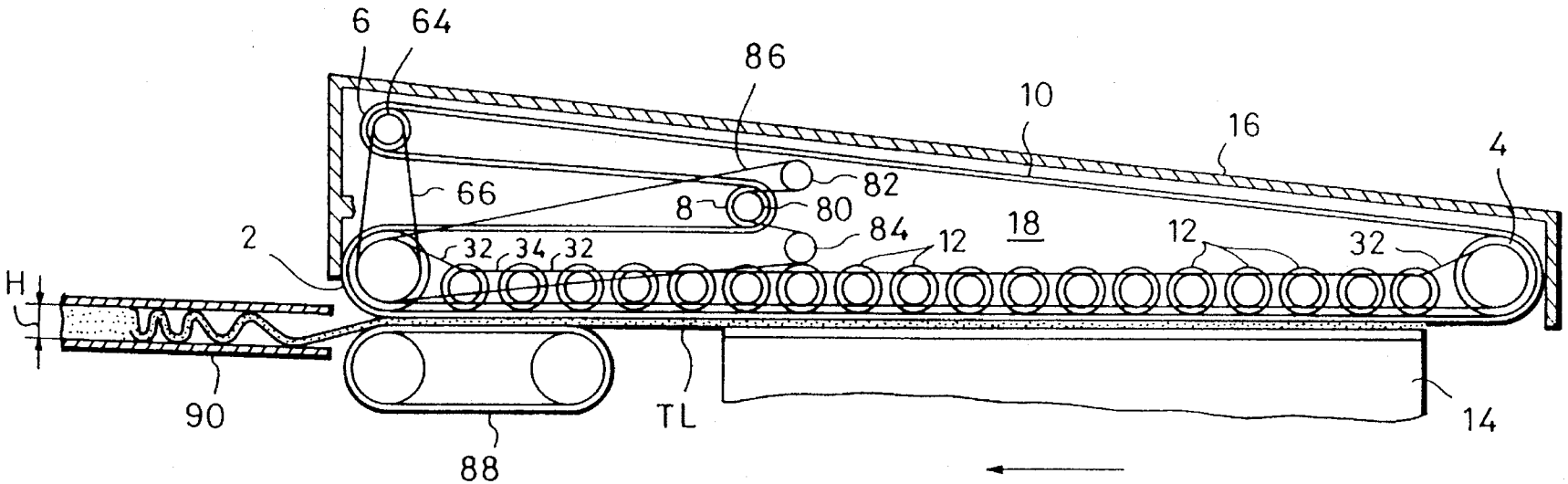
FIG. 1 is a sectional view schematically illustrating a tobacco band apparatus according to one embodiment.

Referring to FIG. 1, a tobacco band apparatus for a cigarette manufacturing machine comprises a head pulley 2 and a tail pulley 4. The head pulley 2 is located on the left-hand side as viewed in FIG. 1, close to a wrapping section (not shown) of the cigarette manufacturing machine, and the tail pulley 4 is arranged on the right-hand side in FIG. 1 at a distance from the head pulley 2. The pulleys 2 and 4 are rotatably supported at the same level.

A tension pulley 6 is rotatably arranged above the head pulley 2. On the right-hand side of the tension pulley 6 is rotatably arranged a change-direction pulley 8 which is located at a level intermediate between the tension pulley 6 and the head pulley 2.

An endless tobacco band 10 is passed round the aforementioned pulleys 2, 4, 6 and 8. The tobacco band 10 comprises a nylon belt, and has a large number of suction holes (not shown) formed therein and distributed uniformly over an entire surface thereof.

The tobacco band 10 has a portion extending horizontally between the head pulley 2 and the tail pulley 4, and this horizontal portion is guided by a number of guide rollers 12. The guide rollers 12 are rotatably arranged at an equal distance from each other and are in contact with the inner surface of the tobacco band 10.

A chimney 14 is arranged immediately below the tobacco band 10 at a location closer to the tail pulley 4. The chimney 14 extends downward and has a shredded tobacco inlet port (not shown) at a lower end thereof.

A casing 16 covers the entire tobacco band 10 from above, and defines a suction chamber 18 therein. The suction chamber 18 is connected to a suction source, not shown, and the interior thereof is maintained at a predetermined suction pressure.

Shredded tobacco fed into the chimney 14 is blown up by air flowing upward in the chimney 14, and then attracted by suction to the outer surface of the tobacco band 10 in the form of a layer due to the suction pressure in the suction chamber 18.

Accordingly, as the tobacco band 10 travels in the direction indicated by arrow in FIG. 1, the shredded tobacco layer TL formed on the tobacco band 10 is transported toward the wrapping section of the cigarette manufacturing machine.

To cause the tobacco band 10 to travel, the head pulley 2, the tail pulley 4, the tension pulley 6, the change-direction pulley 8 and the guide rollers 12 are rotated synchronously at an equal peripheral speed. Namely, the pulleys 2, 4, 6 and 8 and the guide rollers 12 are connected to one another by means of a power transmission path.

Figure 2:
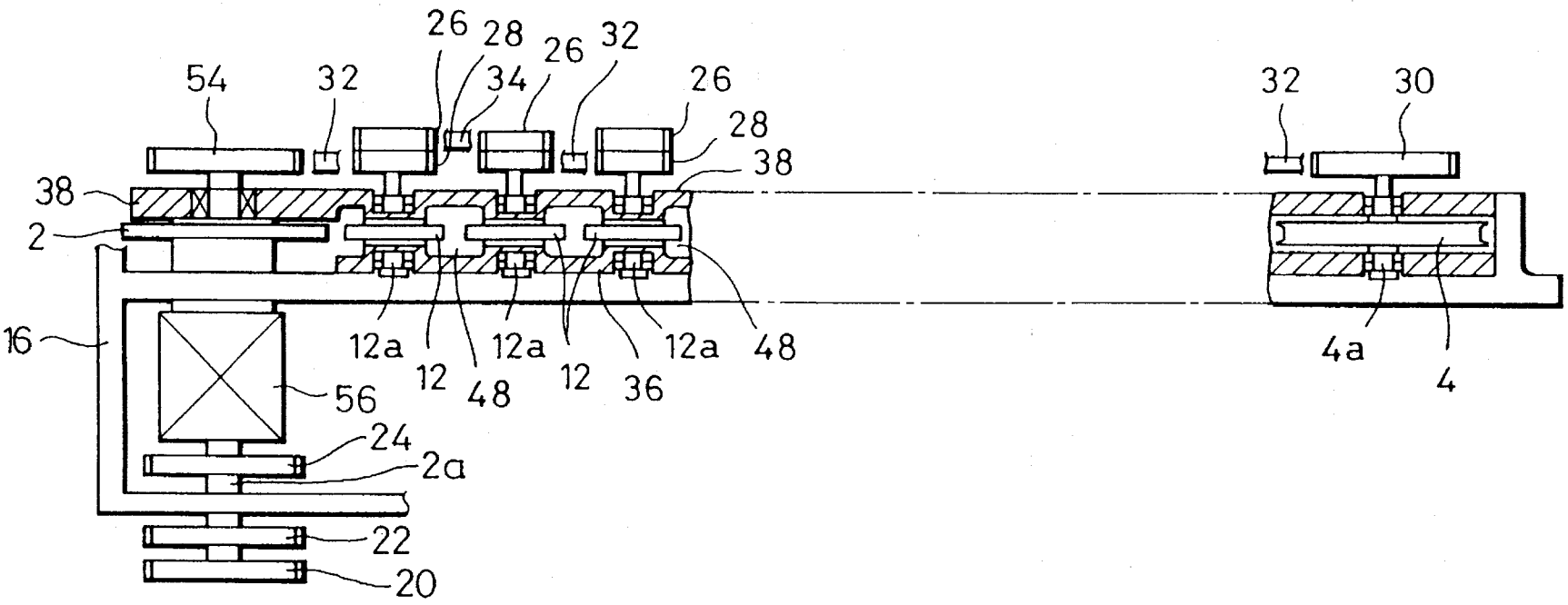
FIG. 2 is a plan view schematically illustrating a power transmission path in the tobacco band apparatus of FIG. 1.

Referring now to FIG. 2, there is schematically shown the power transmission path from the head pulley 2 to the tail pulley 4. The head pulley 2 has a pulley shaft 2*a*, which has one end fitted with a toothed gear pulley 54. Each of the guide rollers 12 has a roller shaft 12*a*, and two toothed pulleys 26 and 28 are mounted on one end of each roller shaft 12*a*. Also, the tail pulley 4 has a pulley shaft 4*a*, and a toothed pulley 30 is mounted on one end of the pulley shaft 4*a*.

The toothed pulley 54 of the head pulley 2, the toothed pulleys 28 of the respective guide rollers 12, and the toothed pulley 30 of the tail pulley 4 are arranged on a first line in the direction of travel of the tobacco band 10. The toothed pulleys 26 of the guide rollers 12 are arranged on a second line parallel with the first line.

These toothed pulleys arranged on the first and second lines are connected as follows. An endless toothed belt 32 is passed round each pair of adjacent ones of the toothed pulleys arranged on the first line, while an endless toothed belt 34 is passed round each pair of adjacent ones of the toothed pulleys arranged on the second line. More specifically, the toothed belt 32 is passed round the toothed pulley 54 of the head pulley 2 and the toothed pulley 28 of the first guide roller 12 adjacent to the head pulley 2, and the toothed belt 34 is passed round the toothed pulley 26 of the first guide roller 12 and the toothed pulley 26 of the second guide roller 12 adjacent to the first guide roller 12. Similarly, the toothed belts 32 and 34 are alternately passed round the adjacent toothed pulleys of the guide rollers 12. Around the toothed pulley 30 of the tail pulley 4 and the toothed pulley 28 of the guide roller 12 adjacent to the tail pulley 4, the toothed belt 32 is wound.

Thus, the power transmission path from the head pulley 2 to the tail pulley 4 via the guide rollers 12 is achieved by the combination of toothed pulleys and toothed belts. When a driving force is input to the pulley shaft 2*a* of the head pulley 2, it is transmitted from the pulley shaft 2*a* to the tail pulley 4 through the individual guide rollers 12. As a result, the head pulley 2, the guide rollers 12 and the tail pulley 4 are rotated synchronously in the same direction at the same peripheral speed.

Figure 3:
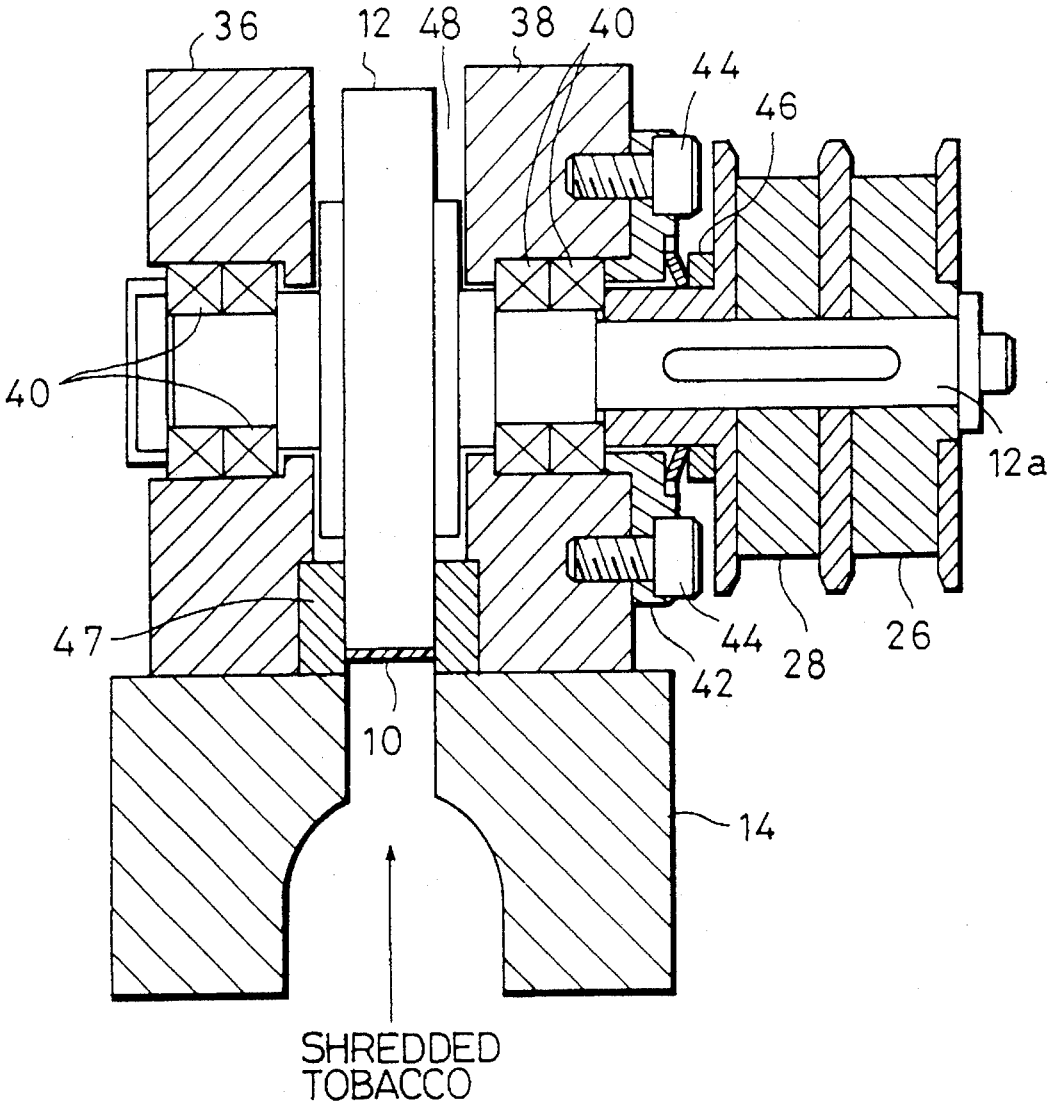
FIG. 3 is a transverse sectional view of the power transmission path shown in FIG. 2.

FIG. 3 illustrates a structure for supporting each guide roller 12. The guide roller 12 is arranged between a pair of bearing plates 36 and 38, and a passage communicating with the aforementioned suction chamber 18 is defined between the bearing plates 36 and 38. The bearing plates 36 and 38 extend in parallel with each other between the head pulley 2 and the tail pulley 4, and have part thereof adjoining the upper side of the chimney 14. The roller shaft 12*a* of the guide roller 12 has opposite ends extending through the bearing plates 36 and 38, respectively, and the opposite ends are each rotatably supported by the corresponding one of the bearing plates 36 and 38 through a pair of bearings 40. A presser disc 42 is attached to the bearing plate 38 by a plurality of screws 44.

One end portion of the roller shaft 12*a* of the guide roller 12 protrudes considerably from the bearing plate 38, and the aforementioned toothed pulleys 26 and 28 are mounted on the projected end by means of a key. A V-seal 46 is interposed between the toothed pulley 28 and the presser disc 42.

A side guide 47 is fitted in the lower part of the inner surface of each of the bearing plates 36 and 38. The side guides 47 extend along the tobacco band 10 and serve to guide the respective side edges of the band 10.

Figure 4:
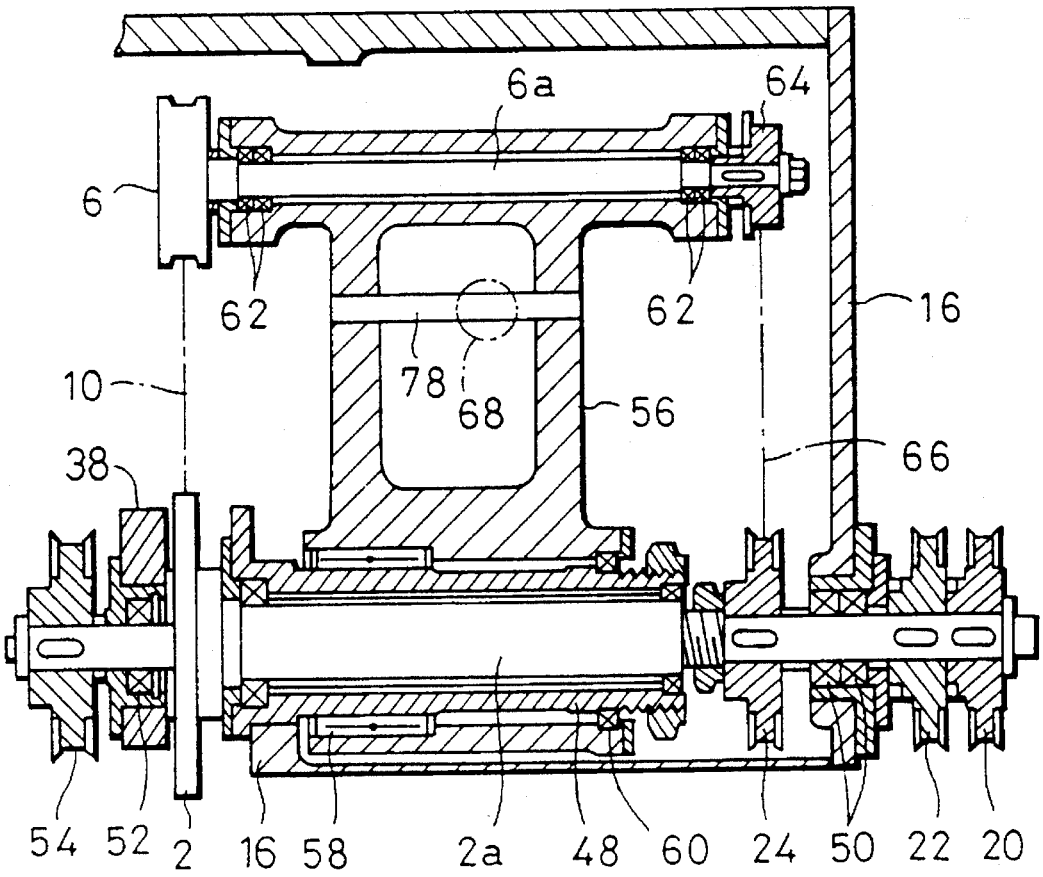
FIG. 4 is a longitudinal sectional view showing a front end portion of the tobacco band apparatus of FIG. 1.

Referring now to FIG. 4, there is shown in detail a structure for supporting the head pulley 2 and the tension pulley 6. The head pulley 2 is located between the bearing plate 38 and a portion of the casing 16, and the pulley shaft 2*a* thereof has one end portion extending through the bearing plate 38. The one end portion of the pulley shaft 2*a* is rotatably supported by the bearing plate 38 through a bearing 52, and the aforementioned toothed pulley 54 is mounted on the projected end portion by means of a key.

The other end portion of the pulley shaft 2*a* extends through a sleeve 48 secured to the casing 16, and further through the casing 16 with bearings 50 interposed therebetween so that the pulley shaft 2*a* may be rotatable relative to the casing 16. Toothed pulleys 20 and 22 are mounted on the other end portion of the pulley shaft 2*a* protruding from the casing 16. A toothed pulley 24 is mounted on a portion of the pulley shaft 2*a* located between the sleeve 48 and the bearing 50.

Although not illustrated, the toothed pulley 20 is coupled to the output shaft of a servomotor through an endless toothed belt and a toothed pulley. Accordingly, the toothed pulley 20 is rotated by the driving force from the servomotor.

To the bearing sleeve 48 is pivotally connected a proximal end of a tension arm 56 through bearings 58 and 60. The tension arm 56 extends upward, and a pulley shaft 6*a* of the aforementioned tension pulley 6 penetrates an upper end portion of the tension arm 56. The pulley shaft 6*a* has opposite end portions rotatably supported by the tension arm 56 through respective bearings 62.

The aforementioned tension pulley 6 is mounted on one end of the pulley shaft 6*a*, and a toothed pulley 64 is mounted on the other end of the pulley shaft 6*a* by means of a key. The toothed pulley 64 is located above the toothed pulley 24, and an endless toothed belt 66 is passed round these toothed pulleys 64 and 24.

When the head pulley 2 is rotated, the driving force is transmitted from the head pulley 2 to the tension pulley 6 through the toothed pulleys 24 and 64 and the toothed belt 66, whereby both the tension pulley 6 and the head pulley 2 are rotated synchronously in the same direction. Owing to the power transmission path from the head pulley 2 to the tension pulley 6, the tension pulley 6 and the head pulley 2 are rotated at the same peripheral speed.

Figure 5:
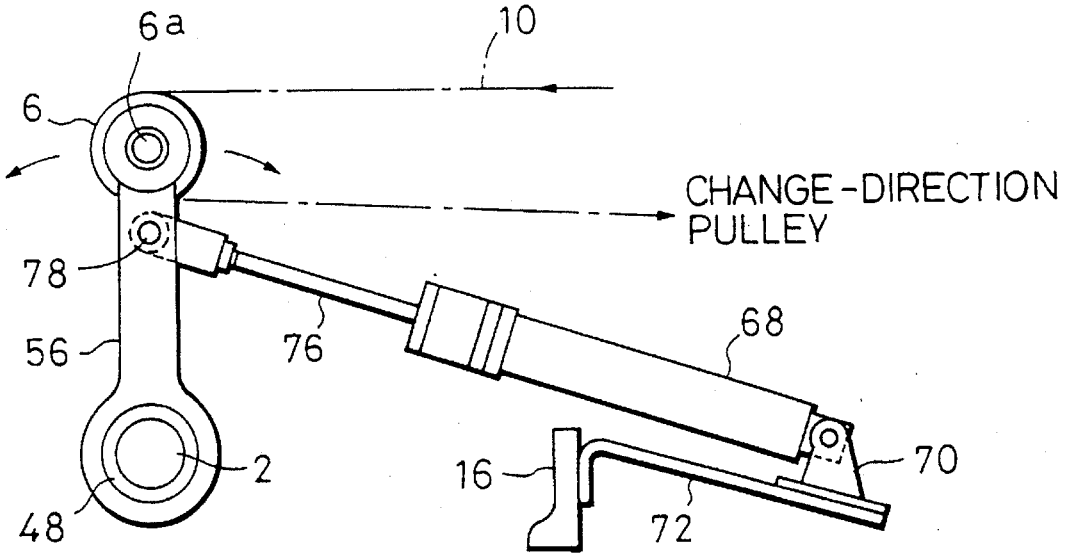
FIG. 5 is a view of a drive mechanism for a tension pulley shown in FIG. 4.

An air cylinder 68 is coupled to the tension arm 56, and this air cylinder 68 is illustrated in detail in FIG. 5. The air cylinder 68 has a proximal end pivotally supported by means of a bracket 70, which is attached to the casing 16 via a mounting plate 72.

A piston rod 76 of the air cylinder 68 extends toward the tension arm 56, and has a distal end coupled to the arm 56 by a connecting pin 78.

As the piston rod 76 of the air cylinder 68 extends or contracts, the tension arm 56 swings in either direction indicated by arrows in FIG. 5, whereby the tobacco band 10 is applied with a predetermined tensile force.

The aforementioned change-direction pulley 8 has a pulley shaft rotatably supported by the casing 16, though a structure for supporting the change-direction pulley 8 is not illustrated in detail. A toothed pulley 80 is mounted on the pulley shaft of the change-direction pulley 8, as shown in FIG. 1, and a pair of toothed pulleys 82 and 84 are arranged in the vicinity of the toothed pulley 80 in such a manner that the pulley 80 is located between the upper and lower pulleys 82 and 84. The toothed pulleys 82 and 84 also have respective pulley shafts rotatably supported by the casing 16.

The toothed pulley 80 of the change-direction pulley 8 and the toothed pulleys 82 and 84 are located at a level higher than the toothed pulley 22 associated with the head pulley 2, and a toothed belt 86 is passed round these pulleys 22, 80, 82 and 84. Accordingly, as the pulley shaft 2*a* of the head pulley 2 rotates, the change-direction pulley 8 also is rotated synchronously with the head pulley 2. In this case, the change-direction pulley 8 is rotated in a direction opposite to that of the head pulley 2, as seen from the manner of passing the toothed belt 86, but the peripheral speed of the change-direction pulley 8 is equal to that of the head pulley 2.

When the head pulley 2 is rotated in the manner described above, its rotating or driving force is transmitted to the guide rollers 12, the tension pulley 6 and the change-direction pulley 8, and these rollers 12 and pulleys 6 and 8 are forcibly rotated together with the head pulley 2.

Since the tobacco band 10 is caused to travel by synchronous rotation of the pulleys and rollers, the tensile force acting on the tobacco band 10 never locally increases; instead the tension is uniform over the entire tobacco band 10. Consequently, the tobacco band 10 is not locally slackened, thus permitting stable attraction of the shredded tobacco to the tobacco band 10 and stable supply of the shredded tobacco from the tobacco band 10 to the wrapping section.

When the tension of the tobacco band 10 becomes greater than a fixed level, the piston rod 76 of the air cylinder 68 is extended so that the tobacco band 10 may always be applied with a fixed tensile force.

Since the pulleys and the guide rollers 12 are forcibly rotated to run the tobacco band 10, as mentioned above, a small tensile force is sufficient to cause the tobacco band 10 to travel. It is, therefore, possible to increase the traveling speed of the tobacco band 10 without increasing the tensile force applied to the tobacco band 10.

The tobacco band 10 travels without slipping on the head pulley 2, tail pulley 4, tension pulley 6, change-direction pulley 8 or guide pulleys 12; therefore, wear of the tobacco band 10 is greatly reduced and the service life of the same is prolonged.

Further, since the change-direction pulley 8 is arranged at a location of the travel path of the tobacco band 10 between the head pulley 2 and the tension pulley 6, the angle by which the tobacco band 10 is wound around the head pulley 2, that is, the arc of contact of the head pulley 2 with respect to the tobacco band 10, can be increased. Accordingly, the driving force of the head pulley 2 is efficiently transmitted to the tobacco band 10, thus permitting stable travel of the tobacco band 10, as well as even higher traveling speed.

In the tobacco band apparatus of this embodiment, the tobacco band 10 is made to travel at a speed several times as high as, for example, five times, the traveling speed of a normal tobacco band. As an example of application, the tobacco band apparatus of this embodiment may be used with the shredded tobacco feeding system disclosed in U.S. Pat. No. 5,337,761. This shredded tobacco feeding system is capable of hardening cigarettes without increasing the amount of shredded tobacco filled in individual cigarettes.

To permit the tobacco band apparatus of this embodiment to be incorporated into such shredded tobacco feeding system, an endless press belt 88 is arranged immediately below the tobacco band 10, as shown in FIG. 1, and this press belt 88 is caused to travel in a direction opposite to that of the tobacco band 10 but at the same speed as the band 10.

On the front side of the tobacco band 10 extends a guide tunnel 90, which is connected to the wrapping section of the cigarette manufacturing machine through a second tobacco band apparatus.

Opposite side walls of the guide tunnel 90 are each composed of a side belt, though not shown in FIG. 1, and these side belts travel in a direction from the tobacco band 10 to the second tobacco band apparatus at a speed equal to that of the normal tobacco band in the second tobacco band apparatus.

Where the tobacco band 10 is caused to travel at a speed five times as high as the normal speed, as mentioned above, the time period within which an object on the tobacco band 10 passes over the chimney 14 is reduced to ⅕. Consequently, the thickness of the shredded tobacco layer TL formed on the tobacco band 10 is reduced approximately to ⅕ of that of a normally formed layer.

As the shredded tobacco layer TL is fed into the guide tunnel 90 from between the tobacco band 10 and the press belt 88, it advances within the guide tunnel 90 while being folded because of the difference of traveling speed between the tobacco band 10 and the side belts. The guide tunnel 90 has a height H five times the thickness of the shredded tobacco layer TL, and the rate of feed of the shredded tobacco into the guide tunnel 90 is equal to the rate of discharge of the shredded tobacco from the same tunnel 90.

Subsequently, the shredded tobacco in the guide tunnel 90 is attracted and transferred to the tobacco band of the second tobacco band apparatus, and then supplied to the wrapping section of the cigarette manufacturing machine.

In this manner, the shredded tobacco attracted to the tobacco band 10 in the form of a layer is supplied to the wrapping section and fed onto paper. In this case, the shreds of tobacco are substantially perpendicular to the paper surface; therefore, a cigarette rod which is obtained by wrapping the shredded tobacco in the paper have increased hardness.

In the shredded tobacco feeding system described above, the second tobacco band apparatus may be an ordinary tobacco band apparatus or be identical with the apparatus of this embodiment except that the travel speed of the tobacco band is reduced to ⅕ of that of the tobacco band 10.

In the foregoing embodiment, toothed pulleys and toothed belts are used to transmit the driving force of the head pulley 2 to the tail pulley 4, tension pulley 6, change-direction pulley 8 and guide rollers 12, but similar effects can be achieved by using various other types of power transmission system, such as gears.

What is claimed is:

1. A tobacco band apparatus for a cigarette manufacturing machine, comprising:

a rotatable head pulley;

a tail pulley rotatably arranged at a distance from said head pulley;

an endless tobacco band passed round said head pulley and said tail pulley and including a straight portion extending straight between said head pulley and said tail pulley, the straight portion of said tobacco band having a lower surface serving as a suction surface to which shredded tobacco is attracted in a layer, and an upper surface facing inward of said tobacco band;

a plurality of guide rollers rotatably arranged between said head pulley and said tail pulley and disposed in contact with the upper surface of the straight portion of said tobacco band;

tension means for applying a predetermined tensile force to said tobacco band; and drive means for rotating said head pulley, said tail pulley and said guide rollers synchronously with each other in an identical direction at an identical peripheral speed.

2. The tobacco band apparatus according to claim 1, wherein said drive means includes a power transmission path for transmitting a driving force input to said head pulley to said tail pulley through said guide rollers.

3. The tobacco band apparatus according to claim 2, wherein said power transmission path includes a toothed pulley arranged coaxially with each of said head pulley, said tail pulley and said guide rollers, and an endless toothed belt passed round each pair of adjacent ones of the toothed pulleys.

4. The tobacco band apparatus according to claim 1, wherein said tension means includes a movable tension lever, a tension pulley rotatably mounted on the tension lever and guiding said tobacco band, urging means for pressing the tension pulley against said tobacco band, and second drive means for rotating said tension pulley and said head pulley synchronously with each other at an identical peripheral speed.

5. The tobacco band apparatus according to claim 4, wherein said second drive means includes a toothed pulley arranged coaxially with each of said head pulley and said tension pulley, and an endless toothed belt passed round the toothed pulleys.

6. The tobacco band apparatus according to claim 4, which further comprises increasing means for increasing an angle by which said tobacco band is wound around said head pulley.

7. The tobacco band apparatus according to claim 6, wherein said increasing means includes a change-direction pulley rotatably arranged between said head pulley and said tension pulley with respect to a traveling direction of said tobacco band, said change-direction pulley guiding said tobacco band for travel.

8. The tobacco band apparatus according to claim 7, which further comprises third drive means for rotating said change-direction pulley at a peripheral speed equal to that of said head pulley.

* * * * *